US006335087B1

(12) United States Patent
Hourahane

(10) Patent No.: US 6,335,087 B1
(45) Date of Patent: Jan. 1, 2002

(54) REINFORCING FOR CONCRETE PRODUCTS AND REINFORCED CONCRETE PRODUCTS

(76) Inventor: Donald Henry Hourahane, 3 Lark Street, Horizon Park 1730, Gauteng Province (ZA)

( * ) Notice: Subject to any disclaimer, the term of this patent is extended or adjusted under 35 U.S.C. 154(b) by 0 days.

(21) Appl. No.: 09/101,753

(22) PCT Filed: Jan. 15, 1997

(86) PCT No.: PCT/US97/00362

§ 371 Date: Nov. 16, 1998

§ 102(e) Date: Nov. 16, 1998

(87) PCT Pub. No.: WO97/26395

PCT Pub. Date: Jul. 24, 1997

(30) Foreign Application Priority Data

Jan. 15, 1996 (ZA) ..... 96/0296

(51) Int. Cl.[7] ..... B32B 25/02

(52) U.S. Cl. ..... 428/295.7; 428/293.4; 428/298.4; 428/369; 428/371; 428/373; 428/374; 428/397; 428/402

(58) Field of Search ..... 428/295.7, 293.4, 428/298.4, 369, 371, 373, 374, 397, 402

(56) References Cited

U.S. PATENT DOCUMENTS

| | | | | |
|---|---|---|---|---|
| 3,596,459 | A | 8/1971 | Wada et al. | 57/160 |
| 3,677,318 | A | 7/1972 | Glass et al. | 152/356 |
| 4,698,956 | A | 10/1987 | Clarke et al. | 57/2 |
| 4,921,756 | A | 5/1990 | Tolbert et al. | 428/373 |

*Primary Examiner*—Richard Weisberger
(74) *Attorney, Agent, or Firm*—Ladas & Parry

(57) ABSTRACT

A yarn for use in a cement mortar matrix, includes a core and a multitude of staple fibers forming a layer which envelopes the core and provides an extended surface area and interstical spaces for infiltration by cement fines and hydrates. The staple fibers are spun around the core and attached to the core, and have sufficient freedom of radial movement to provide said spaces and permit ingress of cement fines and the formation of hydrates in said spaces.

9 Claims, 1 Drawing Sheet

REINFORCING FOR CONCRETE PRODUCTS AND REINFORCED CONCRETE PRODUCTS

FIELD OF THE INVENTION

Figure 1:
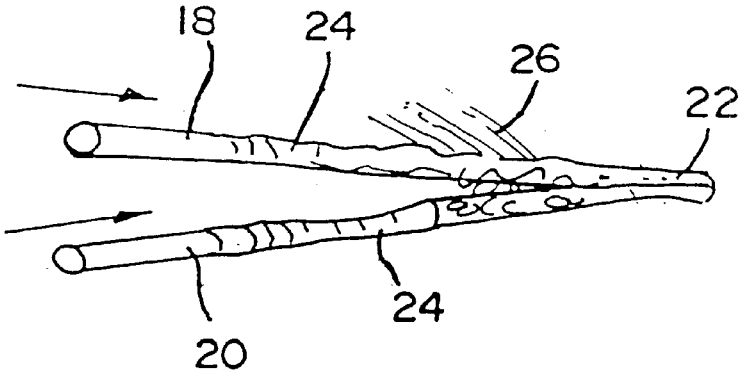

THIS INVENTION relates to reinforced concrete products.

BACKGROUND OF THE INVENTION

Polymeric fibres, tapes and meshes are used as reinforcing in hydraulic matrices (also referred to as cementitous matrices). They are the conventional products of the textile and plastics industries and are primarily intended to be used for spinning and weaving, or have been produced for other purposes. The problems that hydraulic matrices, of which type 1 cement (Ordinary Portland Cement) is an example, have in interfacing with them have not hitherto been addressed to the best of Applicant's knowledge.

The creation of polymeric reinforcing fibre, tape or mesh of high tenacity, involves a draw down or stretch ratio. This can vary in the range 5:1 to 15:1 for extruded tapes and spun multi-filaments and up to 50:1 for solvent/gel spun multi-filaments. In both cases the fibre produced has a smooth surface. Some polymers from which the fibres are made are hydrophobic. For an hydraulic matrix to achieve any significant mechanical, frictional or chemical bond to fibres or yarns made in this way is virtually impossible.

DESCRIPTION OF THE INVENTION

According to one aspect of the present invention there is provided yarn for use in a cement mortar matrix, the yarn including a core and a multitude of staple fibres forming a layer which envelopes the core and provides an extended surface area and interstical spaces for infiltration by cement fines and hydrates, the staple fibres being spun around the core and attached to the core, the staple fibres having sufficient freedom of radial movement to provide said spaces and permit ingress of cement fines and the formation of hydrates in said spaces.

Preferably said core comprises two or more core strands which are twisted together, portions of the staple fibres being trapped between the core strands as the core strands are twisted together thereby to form a mechanical connection between the core strands and the staple fibres. The strands of the core can have adhesive between them.

In one form said core and said staple fibres are of synthetic plastics materials which weld to one another upon being softened, the core and the fibres of the layer being welded to one another at spaced locations along the length of the yarn. In another form said fibres and said core are adhered to one another at spaced locations.

Said layer can consist mainly of fibres with hydrophobic properties intermingled with some fibres which have hydrophillic properties. It is also possible for said layer to include soluble fibres containing additives for enhancing the properties of the hydrate crystals during their formation. Alternatively the core and/or the staple fibres can have thereon a soluble coating containing additives for enhancing the properties of the hydrate crystals during their formation.

According to a further aspect of the present invention there is provided a concrete article with yarn as defined above therein as reinforcing.

The yarn can be used in the form in which it is produced but cut into pieces, or can be woven to form a tape or cloth which is embedded in the concrete matrix.

By using two or more strands in the core, the leading ends of the staple fibres which are fed transversely towards the core during the spinning process can be trapped by the core strands. As the staple fibres are spun around the core and the core strands are twisted, they become mechanically locked together.

Additionally the core strands can be coated in-line with an adhesive of a type compatible with the materials of which the core strands and the staple fibres are made. The staple fibres then also form a barrier which prevents the adhesive from causing a length of the coated finished yarn from sticking to an adjacent length of the yarn.

The function of the core strands is to provided the reinforcing. The staple fibres are there to provide the means for the hydraulic matrix to grip the core strands. The staple fibres offer a surface area several orders of magnitude greater than the surface area of the core strands. Furthermore, their interstices provide a void space which can be infiltrated by the hydraulic matrix, which as it crystallises envelopes the staple fibres, thus forming a composite interface between the reinforcing core and a cementaceous matrix.

The staple fibres preferably consist mainly of hydrophobic material so as not to interfere with the water/cement ratio which significantly influences the strength of the fully cured cement mortar, or concrete, in which the fibre product is used.

The staple fibres can be a blend of fibres, a small percentage of the total having hydrophyllic properties, enabling them to retain sufficient water to ensure that the hydraulic matrix in contact with them is fully cured.

Soluble fibres, or fibres that have a soluble coating, can be included to release additives into the hydraulic matrix that enhance the properties of the cement hydrate crystals as they form, without affecting the properties of the bulk of the matrix. One example of a performance enhancing additive is silica fume. This can change the ratio of the hydrates produced during hydration in an advantageous manner. Another additive is gypsum anhydrate, which when in contact with cement hydrates, can cause expansion. Other additives, and their effect, are known to those skilled in the art.

While dosing via soluble fibres is a preferred method, the additives can also be infiltrated into the interstices of the staple fibres and retained there by the use of a soluble coating. Sodium alginate is the preferred coating.

The staple fibres are preferably applied to the core yarns by a spinning process. An example of such a process is friction spinning as developed by Feher AG of Linz, Austria. Adhesive can be applied in-line immediately prior to the spinning process. The staple fibres then also serve to prevent the adhesively coated strands from sticking to each other. This could be a problem were it not an in-line process. The friction spinning process therefore has to be customised to meet the needs of the method of production of the yarn according to the invention. The use of multiple adhesively coated strands that converge at the point where the staple fibres are being introduced adds an adhesive bond to the mechanical interlock that occurs between the core and the staple fibres.

The friction spun staple fibres can be more loosely applied to the core strands if the core strands are coated with an adhesive before the friction spinning process takes place. This is of particular significance in the case of high tech fibres, where high interlaminar shear forces have to be transmitted through the interface layer of staple fibres into the ultra strong reinforcing core. Such forces can exceed 1 GPa.

A suitable adhesive can be made from a hot melt adhesive by dissolving it in a suitable hot solvent and allowing it to cool. A room temperature volatile gel is thus produced. This can be coated onto the core strands. The solvent volatilises leaving a thin layer of hot melt adhesive gel. The solvent can be recovered and condensed for reuse. The hot melt adhesive can also be formulated to become the carrier of the matrix performance enhancing additives mentioned above.

After the staple fibres have been friction spun onto the surface of the adhesively coated core strands, the composite core can be heated. This softens the adhesive thus heat setting the friction spun fibres to the surface of the core and at the same time creating a ridged surface of adhesive on the core strands along which the staple fibres will, once in the cement matrix, not be able to slide.

Yarn made in accordance with this invention provides interstitial spaces into which cement and its hydrates can flow and mechanically interact with the staple fibres. In some cases additives are included which chemically interact with the cement and/or its hydrates to create a preferred interface, selectively using the hydraulic matrix in which the interactive strands, or products made from them, are used to enhance the matrix where it is to become the interface with the interactive fibre strands.

Yarn made in accordance with this invention comprises two or more components each with its own well defined function.

The yarn can have:

A high tenacity core, to carry the load, the core comprising one, two or more polymeric core strands or alternatively multi-filaments;

one or more layers of staple fibres spun onto the core;

a mechanical locking system between the core and the staple fibres;

an adhesive bonding layer between the core and the staple fibres;

an adhesive that includes additives to react with the hydraulic matrix;

hydrophyllic fibres forming a portion of the staple fibres;

fibres coated with a water soluble adhesive that dissolves releasing additives into the cement as it hydrates;

inclusions in the extended surface layer of the fibres to react chemically with the hydrating cement in order to create a preferred topical matrix.

The surface layer of staple fibres is preferably applied to the high tenacity core by the process known as friction spinning, for which Feher AG, of Linz, Austria supplies suitable equipment.

A preferred embodiment uses a plurality of core strands, the strands being fed in a cone to a nip in order to catch the leading ends of the staple fibres as these are fed transversely towards the nip. With the leading ends of the staple fibres trapped between the strands of the core, spinning serves to bind them in place. Twisting of the core strands enhances the bond.

The staple fibres reinforce the cement interface and transfer the load on the concrete product into the core strands. A load usually results from the bending or flexing of the cement matrix or concrete product in which the yarn is used.

The staple fibres, when wound onto the core, result in a permeable layer of fibres. This makes the yarn suitable for gas treatment, an example being fluorination, and equally suitable for treatment by irradiation. The latter can additionally be used to modify the properties of the adhesive by the process known as cross linking. The fluorination process is known to create a polar surface on certain polymers that can improve its adhesion to hydraulic matrices.

Failure of the presently used polymeric fibres is usually by "pull out" from the concrete. Under load, they increase in length and reduce in diameter thereby freeing themselves from the largely frictional grip of the concrete.

The yarns of this invention are gripped mechanically, and in many cases chemically, by the hydraulic matrix. If the final product fails it is because the matrix, the interface or the fibres themselves have failed under load as pull out of the interactive fibre strands under load is not possible.

During hydration of the cement, the crystals of hydration become the matrix in and around the staple fibres and are modified by additives in or around those staple fibres, so as to become an enhanced matrix. Products made using the methods taught in this application can be internally reinforced and also reinforce to the outer surfaces of the product.

Replacing steel reinforcing systems in chosen applications by yarn according to this invention enables thinner, lighter cement based products to be made. Accelerators can be used that would cause the corrosion of steel, enabling moulds to be more productively utilised.

Bulk concrete products according to the invention are less prone to cracking. Furthermore because the physical properties of the cement matrix interface to the yarn is enhanced, the toughness of the bulk matrix is improved and the deflection under load with respect to steel reinforced concrete is reduced.

The deflection of a conventionally reinforced beam under load leads to cracking of the tensile, or flexural, face of the beam. The greater the deflection the wider the cracks. Cracks that are uniform and fine can self heal. The yarn in accordance with this invention redistributes stress resulting in more but finer cracks. This leads to more durable concrete.

Yarn, tapes and cloths made in accordance with the teachings of this application are more desirable than steel for the purpose of reinforcing cellular or lightweight aggregate cement based products because steel reinforcing is generally incompatible with the significantly reduced compressive strength of lightweight concrete.

The reinforcing core of the yarn can be man made synthetic textile yarns or natural textile yarns. Examples are rayon, nylon, polyester, polyethylene, polypropylene, carbon, Kevlar, gel spun polyethylene or zirconia glass high tech fibres.

All of these fibres can be characterised as having a surface requiring chemical, gas, corona discharge or irradiation treatment to create a surface to which a chemical bond can be achieved by an adhesive matrix. Epoxy or polyester resins are examples of adhesives that will bond after such treatment. However, these treatments do not yield a surface to which a water based matrix such as cement, or its hydrates, can either interlock mechanically or significantly bond chemically. Further these process are not normally used in the textile industry. This leads to multiple handling, increasing the cost of the end product. Such fibres cannot therefore be used as reinforcing unless they form part of composite yarns as described herein.

Cement and similar hydraulic matrices are by their nature used in bulk as low cost matrices. The cost of any required additive or reinforcing is a factor in determining whether or not they would be used. This does not, of course, eliminate such treatments from being used when there is a commercially or technically valid reason to do so.

In some cases it is desirable to apply two layers of friction spun staple fibres, the two layers being spun with opposite helixes, ie by being applied from the opposite ends of the core. This makes it possible for the grip of these fibres to the core to be enhanced.

The extended surface area of the fibres of the composite yarn provides a fibrous surface. This acts partially as a filter allowing only the finer more reactive cement particles and the hydrate gels to enter the interstices of the friction spun fibre layer.

During the hydration of cement, a solution of hydrate gels forms. This solution is composed of water and products leached from the cement by the water. Calcium hydroxide and calcium silicate hydrate are two examples. The latter is the preferred matrix or binder.

The staple fibres are wound in a spiral semi-hoop wise fashion. The volume between the core and the spirally aligned fibres, the adhesive, or specially manufactured fibres, can be used to carry additives that can enhance one or more properties of the cement hydrates. Examples of such additives are sodium and calcium silicate, gypsum, ettringite, rapid hardening cement or pozzalans such as pulverised fuel ash, or silica fume. Other additives will be known to those skilled in the art.

One or more of these additives can be used to cause an interaction with the hydrating cement. As an example, the formation of calcium hydroxide can be suppressed in favour of the formation of calcium silica hydrate. Silica fume is known to be a suitable additive in this regard. Further in the presence of, for example, gypsum anhydrate the cement hydrates can be caused to expand.

The expansion that takes place does so within the confines of the annular space between the inside faces of the staple fibres and the core and has no effect on the bulk of the concrete within which the fibres are being utilised. The additives can be present in soluble coatings on the fibres or in the adhesives used to hold the fibres in place on the core, or as particulate matter infiltrated into the interstices of the fibres and if necessary held in place by a soluble material.

During the expansion of the cement interface matrix, the annularly aligned fibres constrain radially outward expansion, causing the crystals of hydration to press against the reinforcing core of the composite yarn. This leads to an enhanced grip of the core strands by the matrix.

The concept of selectively dosing part of a cement matrix by the incorporation of fibres as the carrier for an enhancement additive has many practical applications, not necessarily limited to the use of such fibres for reinforcing. In this way a direct bond can be established between the hydrates and the extended surface area of the staple fibres, between the hydrates and the core and between the fibrous-cement hydrate composite layer and the cementaceous matrix of the product in which the cement forms the binder or matrix.

By positioning preferential additives so that they only enhance the matrix in contact with the fibres, the full benefit of adding the additives is gained, without having to add the additives to the bulk matrix. There are two reasons to prefer this. Firstly, only the matrix in contact with the fibres is the subject of enhancement. The bulk matrix is not necessarily enhanced by such additives as the fibres are typically a small fraction by volume of the total mix. To modify the bulk mix, for an effect only benefiting the fibre interface, is both counter productive and expensive. Using the extended surface of the reinforcing yarn to selectively alter the characteristics of a bulk cement mix where it contacts the fibres, restricts the reaction between the additive used and the cement to where it is of the most benefit in so far as the reinforcing effect of the fibres is concerned.

Interactive fibre strands such as are described in this application adsorb water, due to reduced surface tension, before the cement hydration process commences. With the exception of natural or hydropyllic fibres they will not absorb water and so will have little or no effect on the critical water/cement ratio.

During consolidation of the cement matrix either by vibration or by vacuum table or other techniques, water carrying with it cement particles penetrates into the friction spun layer of fibres. Intermixing of the particles of cement with the additives contained in this area takes place and the chosen hydrates form.

The calcium silicate hydrate gel from the cement particles can be encouraged to form within the cross-section defined by the outside of the core and the outer extremity of the friction spun layer of staple fibres, namely in the area partially filled with the prechosen additives. The normal hydrate ratio is of the order of 60% calcium silicate to 40% calcium hydroxide. The ratio can be altered to, for example, 80:20.

The calcium silicate hydrate that forms within the layer of fibres crystallises as calcium silicate. Calcium silicate comprises fine, strong but brittle crystals that, as they continue to crystallise, impinge against each other and fuse together. During the crystallisation stage they occupy the interstitial spaces of the staple fibres forming a calcium silicate-fibre composite interface.

Most cementaceous interfaces are brittle and under shock or impact loads fail. A characteristic of the fibre-calcium silicate composite interface is that it is a composite with a mechanical bond both to the reinforcing core and to the cement matrix. Any crystals that form inside the spirally bound hoop like fibres, expand and impinge against the reinforcing core. This effect is enhanced by the use of an additive such as gypsum anhydrate that can be within the friction spun fibre layer.

The fibres in the composite interface reduce the brittleness of the calcium silicate, creating a pseudo ductile interface layer.

The interactive composite yarn described can be used as produced ie in yarn form, or woven into a tape or cloth suitable for use in beam or sheet type applications. The yarn, when is used as it is produced, can be cut into pieces of some chosen length. Longer lengths are required for use in large aggregate mixes and shorter lengths for use in grout type mixes. The shorter the yarn is cut the more its friction spun staple fibres will benefit from the adhesive bond to the core of the composite yarn.

Interactive yarn, cloth etc can be cut using a laser or hot air gun. This also serves to fuse the ends of the staple fibres together and, in the case of a thermoplastics core, to the core. This is beneficial in the absence of an adhesive bond between the fibre outer layer and the core.

During mixing, the fibres can be uniformly dispersed throughout the mix. They serve to prevent demixing during pumping and placing and segregation under vibration. Because the mix remains mixed it is easier to obtain site test results that compare with those obtained in the laboratory.

The reduced surface tension around the strands causes free water to be adsorbed from the concrete mix thus preventing the formation of surface puddles which, when they evaporate, reduce the water-cement ratio. The water adsorbed by the strands remains available to the cement throughout the hydration process.

Reinforcing interactive composite yarns made with a high elongation core can be pre-stressed by, for example, 20%. At practical diameters this results in a reduction of about 10% in the diameter of the reinforcing core. Once the fibrous cement mix has hydrated and the prestressing load is removed the staple fibres and the cement hydrates prevent the core from recovering its original length. The tension in the yarn is therefore converted into a compressive force in the concrete. The fibres in the mix help to contain the force following the release of the pre-stressing force even if, for example, the product is cut through between the places at which the yarn is anchored. Tapes and even woven cloth can be prestressed in this way, enabling load bearing beams and floor panels to be precast. Tapes and cloth have the advantage that they can be cut to fit and maintain the load bearing properties of the whole beam.

Tape and woven cloth made from the interactive yarns described can be dipped into a fluidised bed containing a cementitous powder. The powder infiltrates the friction spun layer of stable fibres. As the tape or cloth leave the fluidised bed, they can be wrapped in a layer of impermeable material such as polyethylene film to keep the dry cement mixture in place. Alternatively a non-woven finely textured tissue can be used. The later can remain in place as a component of the end product.

The subsequent use of such preimpregnated materials need only involve their being wetted and allowed to drain, prior to being used in a mould or against a former for moulding. Pre-impregnated materials are suitable for hand or machine lay up into sheet-like structures. Alternatively they can form the surfaces of a cellular or normal density sandwich panel.

Interactive fibre strands can be used to create satin weave or knitted cloths enabling articles with complex curvatures to be made using these techniques. Polymeric fibres have the advantage of being non aggressive and are therefore not harmful either to the hands of the user, or to the environment in which they are used.

Cloth made from interactive composite yarn acts as a filter. When used to line shuttering it provides a mesh which prevents large aggregate particles from reaching the surface of a shutter during casting. Fines from the concrete mix penetrate the mesh and, flow through the mesh in a controlled manner. The space bounded by the shutter fills from the bottom up, the cement fines displacing air as the space against the shutter face is filled.

If the cloth is displaced away from the shutter by the denser cement and fine sand particles, this gives the face of the pour a fines rich reinforced surface. This reinforced surface is better able to resist impact damage and is less permeable making it ideal for marine use and for use in corrosive environments in general.

Material made in this way can be used after the fashion of papier mache to create strong thin fibre cement mouldings, such as garden ornaments, floor tiles, roofing sheets and boat hulls.

The methods described enable cement matrixed mouldings with more than 10% of fibres by volume to be made. This results in thin, light strong finished products. Because proportionately less matrix is used, additives can be incorporated into the cement matrix, without having a major impact on the cost of the final product. This enables products made using hydraulic matrices to compete for market share with those made from solvent based, or catalytic resin systems.

Reinforcing yarn with a friction spun surface is particularly suitable for use in cellular cement and low density aggregate cement mixes where traditional reinforcing, such as steel bars or meshes, are less effective. The cellular/lightweight aggregate mixes develop insufficient strength to be able to grip steel reinforcing. The larger surface area of the described yarn etc is more suitable.

Cellular fibre or lightweight aggregate cement mixes used in conjunction with woven cloth or tape made in according with the methods disclosed in this application are suitable as an alternative to wooden joists or plywood. The cement composite fibre ply is suitable for use where marine ply would otherwise be specified and is particularly suitable for use as lost formwork. Such a formwork remains in place as the finished surface of the concrete.

A specific example of application is waffle or trough type floors as it avoids the problem of having to strip, clean and store large mouldings or shutters. A further example of use is as highway barriers. These can stack for ease of transport, can be quickly positioned and bolted together without the need for lifting equipment. The hollow core can be used to hold a plastics bag filled with water. A vent valve can be provided on the bag to allow the water to escape at a controlled rate on impact. Alternatively, the units can be back filled with soil, sand, or concrete. In the latter case they can be used with a weak mix as left insitu moulds, or with a strong mix as re-usable moulds.

FIG. 1 illustrates the preferred method of producing a yarn in accordance with the present invention. The two strands designated 18 and 20 together constitute a core designated 22. The strands 18 and 20 are fed on a converging path to a nip. At the nip the staple fibres 26 are presented to the strands and their leading ends are trapped between the strands. In accordance with the present invention the strands preferably have an adhesive coating 24 applied thereto just before they reach the nip. The adhesive coating secures the strands 18, 20 to one another and also assists in binding the staple fibres. The staple fibres 26 themselves form a cover for the adhesive coating 24. This prevents adhesion between turns of the yarn when it is wound onto a bobbin or the like.

The yarn produced by the process described has a central core and a fluffy sheath of staple fibres. Each fibre has the end thereof which was presented to the nip trapped between the strands and the remainder of the fibre is wound in a helical manner around the core. Because each staple fibre is overlapped by a multitude of other staple fibres, the end result is that the core is entirely sheathed by a layer of staple fibres.

The staple fibres of the sheath are secured to the core at intervals along the length of the yarn. This can be achieved by passing the yarn through heated rollers which make contact with the yarn at intervals of, for example, 5 mm. As each individual staple fibre extends for about 40 mm along the core, it is thus attached to the core at six to nine locations.

Figure 2:
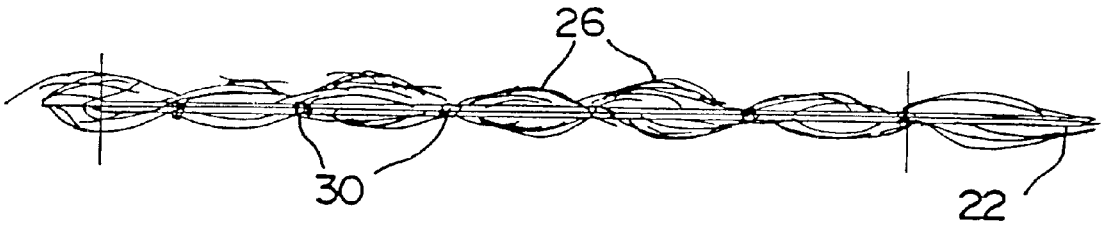

The resulting yarn, as shown in FIG. 2, has spaced locations 30 at which the fibres of the sheath are secured to the sheath. Between these locations the fibres are spaced outwardly from the sheath leaving spaces between the core and the staple fibres. It is these spaces that the cement fines and hydrates enter when the yarn is used for reinforcing purposes.

Figure 3:
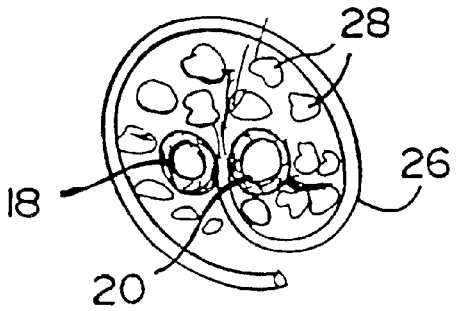

FIG. 3 is a diagrammatic cross section which shows the strands 18, 20. It also shows the fibres 26. Reference numeral 28 designates crystals that have formed within the fibrous cover constituted by the staple fibres 26. As explained above the product can include an additive which promotes formation of the requisite crystals.

It is also possible to use staple fibres of different types. Simply by way of example, 90% of the staple fibres in a product can be hydrophobic, 5% can be hydrophyllic and 5% can be of resorbable material.

What is claimed is:

1. A yarn for use in a cement mortar matrix, the yarn including a core and a multitude of staple fibres forming a layer which envelopes the core and provides an extended surface area and interstical spaces for infiltration by cement fines and hydrates, the staple fibres being spun around the core and attached to the core, the staple fibres having sufficient freedom of radial movement to provide said spaces and permit ingress of cement fines and the formation of its hydrates in said spaces.

2. A yarn as claimed in claim 1, wherein said core comprises two or more core strands which are twisted together, portions of the staple fibres being trapped between the core strands as the core strands are twisted together thereby to form a mechanical connection between the core strands and the staple fibres.

3. A yarn as claimed in claim 1, wherein the strands of the core have adhesive between them.

4. A yarn as claimed in claim 1, wherein said core and said staple fibres are of synthetic plastics materials which weld to one another upon being softened, the core and the fibres of the layer being welded to one another at spaced locations along the length of the yarn.

5. A yarn as claimed in claim 1, wherein said fibres and said core are adhered to one another at spaced locations.

6. A yarn as claimed in claim 1, wherein said layer consists mainly of fibres with hydrophobic properties intermingled with some fibres which have hydrophillic properties.

7. A yarn as claimed in claim 1, wherein said layer includes soluble fibres containing additives for enhancing the properties of the hydrate crystals during their formation.

8. A yarn as claimed in claim 1, wherein the core and/or the staple fibres have thereon a soluble coating containing additives for enhancing the properties of the hydrate crystals during their formation.

9. A cement mortar product reinforced by yarn as claimed in claim 1.

* * * * *